US005659867A

United States Patent [19]

Young

[11] Patent Number: 5,659,867

[45] Date of Patent: Aug. 19, 1997

[54] INSTANT-ON FUSER ROLLER STRUCTURE

[75] Inventor: Jeffery M. Young, Boise, Id.

[73] Assignee: Hewlett-Packard Company, Palo Alto, Calif.

[21] Appl. No.: 563,476

[22] Filed: Nov. 28, 1995

[51] Int. Cl.[6] ..... G03G 15/20

[52] U.S. Cl. ..... 399/330; 219/216; 219/470

[58] Field of Search ..... 355/285, 289, 355/290; 219/216, 469, 470, 471; 432/60; 118/60; 399/330

[56] References Cited

U.S. PATENT DOCUMENTS

| | | | |
|---|---|---|---|
| 3,381,116 | 4/1968 | Menich | 219/470 |
| 4,097,723 | 6/1978 | Leitner et al. | 219/469 X |
| 4,266,115 | 5/1981 | Dannatt | 219/216 |
| 4,628,183 | 12/1986 | Satomura | 219/216 |
| 4,724,303 | 2/1988 | Martin et al. | 219/216 |
| 4,743,940 | 5/1988 | Nagasaka et al. | 355/289 |
| 4,883,941 | 11/1989 | Martin et al. | 219/216 |
| 5,402,211 | 3/1995 | Yoshikawa | 355/285 |

FOREIGN PATENT DOCUMENTS 8-162262 6/1996 Japan .

*Primary Examiner*—Arthur T. Grimley
*Assistant Examiner*—Sophia S. Chen

[57] ABSTRACT

A fuser roller for use in an electrophotographic process includes a hollow cylinder that is constructed of a ceramic material having a high thermal conductivity and exhibiting a wall thickness that is thin in comparison to the radius of the cylinder. Plural resistive conductors are positioned on an external surface of the cylinder. A coating is overlaid on the resistive conductors and the cylinder and forms a continuous, smooth, outer surface for the fuser roller. A first conductive ring is positioned about one end of the cylinder and a second conductive ring is positioned about a second end of the cylinder. Both the first ring and second ring connect to each of the resistive conductors. A circuit is provided for applying a voltage between the first conductive ring and the second conductive ring to cause a current flow through the resistive conductors and a heating of the hollow cylinder so as to bring its temperature up to a required fusing temperature.

8 Claims, 2 Drawing Sheets

INSTANT-ON FUSER ROLLER STRUCTURE

FIELD OF THE INVENTION

This invention relates to electrophotographic printing and, more particularly, to a fuser roller structure which reduces warm-up time during the electrophotographic printing operation.

BACKGROUND OF THE INVENTION

In electrostatic printing, after toner has been deposited on a media sheet, the toner must be fused to the media sheet. This action requires that a fuser station heat the toner to a toner fusion temperature (e.g., approximately 190° C.). Toner fusing has been accomplished in a number of ways. One method employs a heating element (e.g., a long, thin light bulb, in some cases) placed inside a rotating metal cylinder. This method has the advantage of temperature stability due to the thermal mass and intrinsic energy reserve of the rotating metal cylinder. Its disadvantage is that it requires considerable energy to initiate and sustain the fusing process. Thus, a substantial "warm-up" period is required before an actual printing/copying operation can commence.

A further prior art fusing apparatus (see FIG. 1) employs a ceramic heating element placed directly over a media sheet fusing path. The ceramic heater is separated from the media sheet by a flexible, tubular belt that rotates at the same rate as a pressure roller disposed below the media sheet. Ceramic heater 10 is separated from media sheet 12 and toner particles 14 by a fuser film cylinder 16. Fuser film cylinder 16 is comprised of a thin polymeric cylinder which is caused to rotate in the direction shown by arrow 18 (by means not shown). A pair of guides 22 cause fuser film cylinder 16 to maintain its cylindrical shape in the region of contact to media sheet 12. A pressure roller 24 forces media sheet 12 (and toner particles 14) against fuser film cylinder 16 and ceramic heater 10 to enable fusing of the toner particles.

The structure shown in FIG. 1 allows ceramic heater 10 to be in pressure contact with toner particles 14 through a very thin thickness of the polymer sheet which comprises fuser film cylinder 16. The rotation of fuser film cylinder 16 prevents smearing of the toner as it passes through the fuser station. Temperature control of ceramic heater 10 is achieved by signals provided by a thermistor 26 resident on ceramic heater 10.

While the structure of FIG. 1 provides an "instant-on" fusing action, the polymeric material which comprises fuser film cylinder 16, tends to tear. Further, friction between the lower-most surface of ceramic heater 10 and fuser film cylinder 16 causes wear of the inner surface of fuser film cylinder 16 and shortens its lifetime. Further, when attempts are made to speed up the fusing process, the temperature of ceramic heater 10 must be raised to assure a proper fusing action. Under such circumstances, the temperature of fuser film cylinder 16 may approach its flow state and destroy the cylinder.

Accordingly, it is an object of this invention to provide an improved fuser structure which enables an instant-on action in an electrophotographic printer/copier.

It is another object of this invention to provide an improved fuser roller structure which enables a high-speed fusing action.

It is yet another object of this invention to provide an improved fuser roller structure which enables both instant-on operation and high speed fusing, while exhibiting high reliability and long lifetime.

SUMMARY OF THE INVENTION

A fuser roller for use in an electrophotographic process includes a hollow cylinder that is constructed of a ceramic material having a high thermal conductivity and exhibiting a wall thickness that is thin in comparison to the radius of the cylinder. Plural resistive conductors are positioned on an external surface of the cylinder. A coating is overlaid on the resistive conductors and the cylinder and forms a continuous, smooth, outer surface for the fuser roller. A first conductive ring is positioned about one end of the cylinder and a second conductive ring is positioned about a second end of the cylinder. Both the first ring and second ring connect to each of the resistive conductors. A circuit is provided for applying a voltage between the first conductive ring and the second conductive ring to cause a current flow through the resistive conductors and a heating of the hollow cylinder so as to bring its temperature up to a required fusing temperature.

DETAILED DESCRIPTION OF THE INVENTION

Briefly stated, the invention comprises a cylindrical ceramic tube with a plurality of resistive conductors deposited on its exterior surface, all covered by a continuous, smooth, glassy coating. As such, the structure comprises an integrated fuser roller/heater which exhibits low thermal mass and provides instant-on fusing capability.

Figure 2:
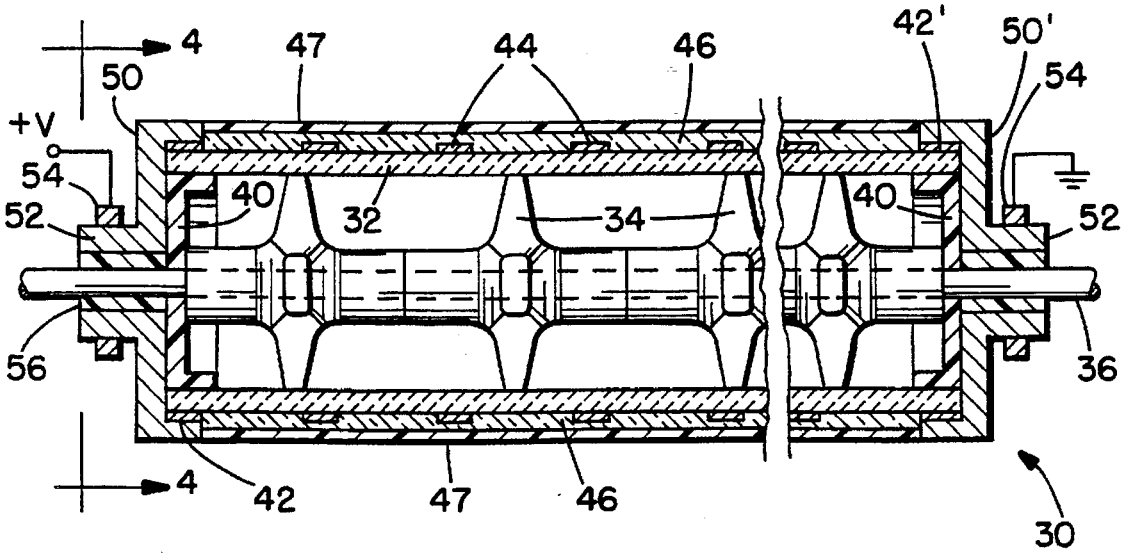
FIG. 2 is a sectional view of a fuser roller incorporating the invention hereof.
Figure 2A:
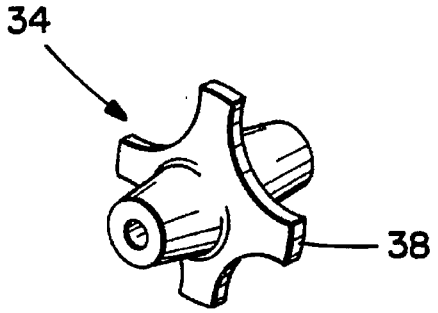
FIG. 2*a* illustrates an internal support structure for the fuser roller of FIG. 2.

As shown in FIG. 2, fuser roller 30 comprises a ceramic tube 32 which is provided with a plurality of internal support structures 34 that are, in turn, mounted on a shaft 36. Each support structure 34 (see FIG. 2*a*) includes a plurality of bearing surfaces 38 which bear on the inner circumference of ceramic tube 32 and provides structural support therefor. It is preferred that bearing surfaces 38 are the minimum required to enable structural support of cylinder 32, thus providing as little heat transfer surface as possible.

Figure 4:
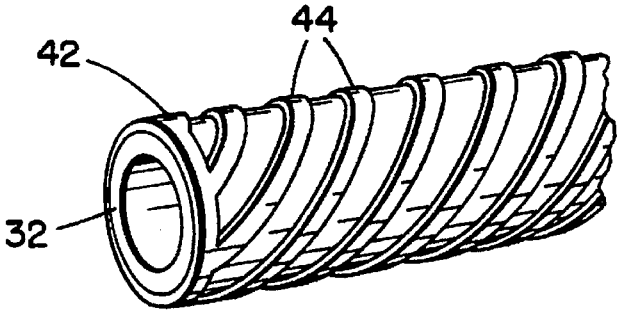
FIG. 4 is a perspective view of the fuser roller of FIG. 2, wherein the outer coating has been removed to expose a helical resistive conductor structure.
Figure 5:
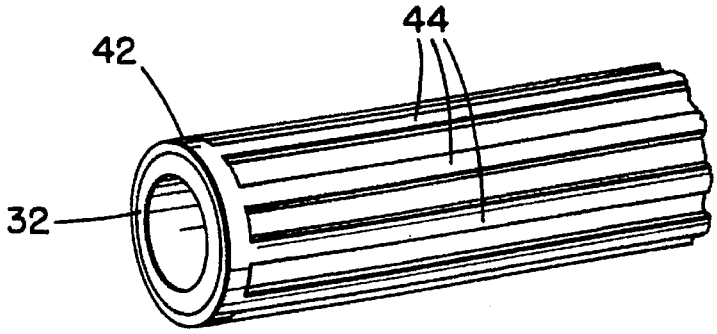
FIG. 5 is a perspective view of the fuser roller of FIG. 2 with the outer coating removed to expose a linear resistive conductive structure.

Returning to FIG. 2, an end support 40 is positioned at either end of ceramic tube 32 and provides internal structural support therefor. Conductive rings 42 and 42' are positioned about the outer surface of ceramic tube 32, at either end thereof. Extending between conductive rings 42, 42' are a plurality of resistive conductors 44 which either may be wound around the external surface of ceramic tube 32 in a helical fashion or extend in a linear fashion there along, as shown respectively, in FIGS. 4 and 5. The helical winding structure shown in FIG. 4 is most preferred as it tends to more uniformly heat tube 32. Thus, a continuous electrical circuit exists between either end of ceramic tube 32 and comprises cylindrical conductors 42, 42' as interconnected by resistive conductors 44.

Figure 3:
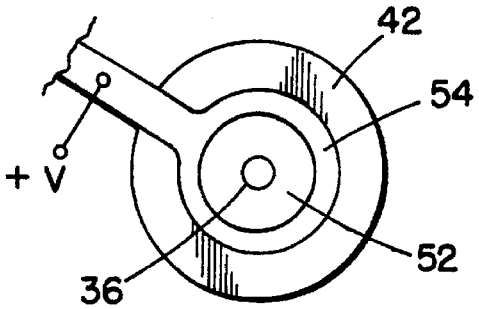
FIG. 3 illustrates an end view of the structure of FIG. 2, showing how electrical connections are made thereto.

A continuous glassy coating 46 is overlaid onto conductors 44 and provides a smooth, exterior surface for ceramic tube 32. During the deposition of glassy coating 46, conductive rings 42 are masked so as to prevent any glass deposition thereon. Thereafter, a pair of conductive end caps 50,50' are positioned at either end of ceramic tube 32 and make electrical contact with conductive rings 42, 42', respectively. Each end cap 50, 50' has an outwardly extending flange portion 52 on which is mounted a contact ring 54 (see FIG. 3), to which a voltage is applied. A polymeric bushing 56 insulates end caps 42 from shaft 36. A thin coating 47 of polytetrafluoroethylene (i.e. "Teflon" which is (a trademark of the Dupont Corp, Wilmington, Del.) provides a non-stick surface over glassy coating 46.

Figure 1:
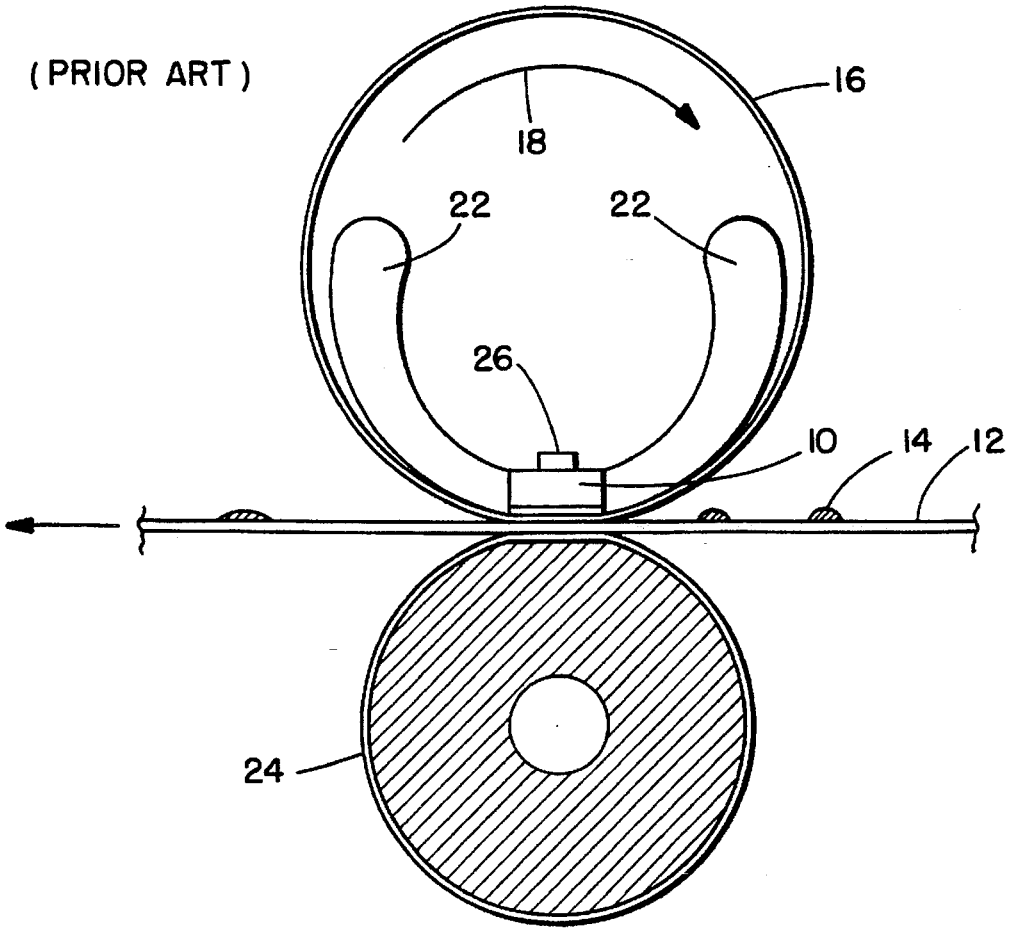
FIG. 1 is a schematic view of a prior art fusing structure.

In operation, fuser roller 30 is positioned in the paper path and abuts a pressure roller such as shown at 24 in FIG. 1. A resilient surface on the pressure roller presses a media sheet against Teflon coating 47 so as to enable a fusing of toner present on the media sheet. Prior to passage of a media sheet between fuser roller 30 and the pressure roller, a voltage is applied to contact rings 54, and via end caps 50, 50' to resistive conductors 44. As a result, the walls of ceramic tube 32 are heated, as is glassy surface 46 and Teflon coating 47, to the fusing temperature. Due to the relatively low mass of fuser roller 30, its temperature rise is extremely rapid and enables a substantially "instant-on" fusing action to occur. More specifically, application of a voltage to conductors 44 enables fuser roller 30 to perform a fusing action within a matter of seconds after voltage application.

A preferred material for ceramic roller 32 is alumina or another high-strength ceramic material having an equivalent thermal conductivity. The diameter of cylinder 32, its wall thickness and material will, to a great extent, depend upon fusing process throughput requirements. Resistive conductors 44 are preferably stenciled, screened or masked onto ceramic tube 32 and subsequently fired. After the resistive conductor structure has been fired, a filler glaze is squeegeed over the surface of resistive conductors 44 so as to fill in the gaps therebetween and to create a smooth outer surface. The glaze is then fired and, if necessary, a final smoothing glaze may be applied and fired. Lastly, a thin coating of a high-slip polymer (e.g. Teflon) may be applied.

The above-described fuser roller integrates both the conductive heaters and ceramic tube into a unitary fuser roller structure and eliminates any sliding contact between a fuser film and heating element as in the prior art of FIG. 1. Further, the low thermal mass of fuser roller 30 enables extremely rapid heating thereof and a substantially instant-on fusing action thereof.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A fuser roller for use in an electrophotographic process, comprising:

a hollow dielectric, ceramic cylinder exhibiting an outer insulating surface;

plural resistive conductors resident on said insulating surface;

a coating overlaid on said resistive conductors and exposed areas of said insulating surface and forming a continuous, smooth outer surface on said hollow dielectric, ceramic cylinder;

a first conductive means positioned at one end of said cylinder and a second conductive means positioned at a second end of said cylinder, both said first conductive means and second conductive means in contact with said plural resistive conductors; and means for applying a voltage between said first conductive means and said second conductive means for creating a current flow through said plural resistive conductors to cause a heating thereof and a transfer of said heating to said cylinder and said coating.

2. The fuser roller as recited in claim 1, wherein said first conductive means and second conductive means comprise conductive rings positioned at either end of said cylinder.

3. The fuser roller as recited in claim 1, wherein said cylinder is comprised of alumina.

4. The fuser roller as recited in claim 1, wherein a wall thickness of said dielectric, ceramic cylinder is small compared to a radius of said dielectric, ceramic cylinder and support means are positioned within said dielectric, ceramic cylinder to provide structural rigidity to said dielectric, ceramic cylinder.

5. The fuser roller as recited in claim 1, wherein said plural resistive conductors are helically wound around said outer insulating surface.

6. The fuser roller as recited in claim 1, wherein said plural resistive conductors extend linearly along said outer insulating surface and between said first conductive means and second conductive means.

7. The fuser roller as recited in claim 1, wherein said coating comprises a glassy layer.

8. The fuser roller as recited in claim 7, wherein said coating comprises a smooth polymeric layer positioned on a glassy layer.

* * * * *